US007758442B2

(12) United States Patent
Lloyd

(10) Patent No.: US 7,758,442 B2
(45) **Date of Patent: *Jul. 20, 2010**

(54) GOLF SWING TRAINING DEVICE

(76) Inventor: Keith Reginald Lloyd, 1 Cook St., Goondiwindi, QU (AU) 4390

( * ) Notice: Subject to any disclaimer, the term of this patent is extended or adjusted under 35 U.S.C. 154(b) by 0 days.

This patent is subject to a terminal disclaimer.

(21) Appl. No.: 12/402,858

(22) Filed: Mar. 12, 2009

(65) Prior Publication Data

US 2009/0170624 A1 Jul. 2, 2009

Related U.S. Application Data

(63) Continuation of application No. 10/549,060, filed on Sep. 13, 2005, now Pat. No. 7,513,834.

(51) Int. Cl.
*A63B 69/36* (2006.01)

(52) U.S. Cl. ..... 473/257; 473/166

(58) Field of Classification Search ..... 473/207, 473/219, 229, 257, 261, 266
See application file for complete search history.

(56) References Cited

U.S. PATENT DOCUMENTS

| | | | | |
|---|---|---|---|---|
| 772,763 | A | 10/1904 | Walters | |
| 2,167,572 | A | 7/1939 | Howe | |
| 2,520,287 | A | 8/1950 | Plunkett et al. | |
| 3,489,416 | A | 1/1970 | Mark | |
| 3,658,344 | A | 4/1972 | Kimble | |
| 3,698,721 | A | 10/1972 | Stewart | |
| 3,703,294 | A | 11/1972 | Fitch | |
| 3,730,531 | A | 5/1973 | Zega | |
| 3,744,799 | A | 7/1973 | Hightower | |
| 3,795,399 | A | 3/1974 | Beckish | |
| 4,000,905 | A | 1/1977 | Shirhall | |
| 4,034,991 | A | 7/1977 | Oppenheimer | |
| 4,071,251 | A | 1/1978 | Beckish | |
| 4,146,231 | A | 3/1979 | Merkle et al. | |
| 4,164,352 | A | 8/1979 | O'Brien | |
| 4,211,418 | A | 7/1980 | Oppenheimer | |
| 4,434,983 | A | 3/1984 | Taggart | |
| 4,583,738 | A | 4/1986 | Fava | |
| 4,815,743 | A * | 3/1989 | Meeker et al. | 473/257 |
| 5,039,105 | A | 8/1991 | Ro | |
| 5,159,715 | A | 11/1992 | Jurga et al. | |
| 5,207,430 | A | 5/1993 | Goins | |
| 6,077,169 | A | 6/2000 | Florian | |
| 6,165,079 | A | 12/2000 | Czaja | |
| 6,582,319 | B2 | 6/2003 | Czaja | |
| 6,595,865 | B2 | 7/2003 | Stitz | |
| 7,025,689 | B2 | 4/2006 | Infalt | |
| 7,513,834 | B2 * | 4/2009 | Lloyd | 473/257 |
| 2003/0176229 | A1 | 9/2003 | Schutte et al. | |
| 2004/0198525 | A1 | 10/2004 | Bender | |

(Continued)

FOREIGN PATENT DOCUMENTS

| | | |
|---|---|---|
| AU | 39793/78 | 3/1980 |

(Continued)

*Primary Examiner*—Nini Legesse
(74) *Attorney, Agent, or Firm*—Summa, Additon & Ashe, P.A.

(57) ABSTRACT

A golf swing training device is disclosed that includes a substantially planar surface. In use, the surface acts as a guide for the movement of a golfer's shoulders when the golfer executes a substantial portion of a backswing.

17 Claims, 5 Drawing Sheets

U.S. PATENT DOCUMENTS

| | | | |
|---|---|---|---|
| 2006/0172271 | A1 | 8/2006 | Lloyd |
| 2007/0015598 | A1 | 1/2007 | Lloyd |

FOREIGN PATENT DOCUMENTS

| | | |
|---|---|---|
| AU | 80120/82 | 8/1982 |
| AU | 91611/82 | 8/1983 |
| AU | 60720/86 | 2/1987 |
| WO | 82/01471 | 5/1982 |
| WO | 85/00295 | 1/1985 |
| WO | 85/00529 | 2/1985 |
| WO | 85/02780 | 7/1985 |
| WO | 92/04082 | 3/1992 |
| WO | 92/05844 | 4/1992 |
| WO | 92/07628 | 5/1992 |
| WO | 92/09336 | 6/1992 |
| WO | 92/09338 | 6/1992 |

* cited by examiner

GOLF SWING TRAINING DEVICE

RELATED APPLICATIONS

This is a continuation of Ser. No. 10/549,060 which claims priority from PCT/AU04/00304 filed Mar. 12, 2004 and from AU2003901136 filed Mar. 13, 2003.

FIELD OF INVENTION

The present invention relates to training devices and especially to a golf swing training device.

BACKGROUND OF INVENTION

A golfer may practice his golf swing for many hours by hitting large numbers of golf balls and judging the effect on the ball to assess the proficiency of the swing. This allows the golfer to practice important aspects of the game but does not really teach the development of a correct swing. It is often stated that the correct swing should include the golf club being swung in an arc which is substantially planar and that a very important aspect in ensuring a correct swing is to have a correct backswing.

A golfer may practice his or her golf swing under the guidance of an instructor or alternatively by following instructions given on practice videos or from books. The actions of a backswing include swinging a golf club in progression from the address position through the backswing and finally to the top of the swing whilst ensuring correct position of the shoulders, hands and club-head. A golfer may develop a poor backswing in some instances, particularly without the guidance of an instructor. This may lead to the golf-club being swung above or below the correct plane which may result in an incorrect forward stroke and follow-through which results in poor golf shots being played.

It would therefore be desirable if at least some of the preferred embodiments of the present invention provide a training device which will allow a golfer to practice a correct backswing which will provide a correct "feel" enabling the golfer to improve his or her golf swing. It would also be desirable if at least some of the preferred embodiments of the invention provide a training device which is simple to use and may be used in the yard of a house or similar area.

SUMMARY OF THE INVENTION

According to a first aspect of the present invention there is provided a golf swing training device comprising a substantially planar surface wherein the surface in use acts as a guide for the movement of a golfer's shoulders when the golfer executes a substantial portion of a backswing.

Preferably, in use, the device guides the golfer's shoulders so that they remain in a plane during a substantial portion of the backswing.

Preferably, the device comprises a club guiding portion for guiding a golf club head through at least a portion of the backswing.

Preferably, the golf head remains in the plane during a substantial portion of the backswing.

Preferably, the surface defines the plane.

Preferably, the surface extends substantially to the ground.

Preferably, the club guiding portion comprises a curved edge of the surface.

Preferably, in use, the surface is adapted to engage the shoulders of the golfer during a substantial portion of the backswing.

Preferably, the surface is defined by a sheet of material.

Preferably, the sheet is a thin, substantially rigid sheet.

Preferably, the device further comprises a position indicator to indicate the correct position for the golfer to stand relative to the device.

Preferably, the position indicator comprises an aperture formed in the planar surface, such that in use the golfer's head may pass therethrough.

Preferably, the device further comprises adjusters for adjusting the position indicator so that golfers of various dimensions may be correctly accommodated relative to the device.

Preferably, the adjusters comprise at least one positionable closure member which is adapted to partially occlude the aperture which comprises the position indicator.

Preferably, the adjusters comprise two positionable closure members which are adapted to partially occlude the aperture which comprises the position indicator.

Preferably, the positionable closure members comprise slidable plates.

Preferably, the closure members are adapted to be positionable by displacement in respective perpendicular directions.

Preferably, at least one of the closure members is positionable by sliding relative to the sheet.

Preferably, the device further comprises a swing viewer to allow the golfer to observe his or her backswing.

Preferably, the swing viewer comprises a window in the planar surface.

Preferably, the device further comprises an anchor for coupling a first end of the planar surface to the ground.

Preferably, the anchor comprises a foot portion, connected to the first end of the surface and adapted to rest on the ground.

Preferably, the foot portion is adapted to be fixed to the ground by one or more anchor pegs.

Preferably, the device further comprises a support for elevating a second end of the surface relative to the first end so that the surface defines the plane extending between the golfer's shoulders and the club-head during the backswing.

Preferably, the support comprises an attachment member.

Preferably, the device further comprises a spacing member which, in use, spaces apart the curved edge from the ground.

Preferably, the spacing member enables the club-head to pass between the curved edge and the ground when the golfer executes a backswing.

Preferably, the spacing member has a first portion which, in use, extends upwards and away from the surface.

Preferably, the first portion, in use, is connected to the surface.

Preferably, the spacing member has a second portion, which is connected at one end to the first portion, and in use engages the ground at the other end.

Preferably, the second portion, in use, enables the club-head to pass the spacing means when the golfer executes a backswing.

Preferably, the second portion is generally L-shaped.

Preferably, the device also comprises a hand guide member adapted, in use, to guide the movement of the golfer's hands when the golfer executes a substantial portion of a backswing.

Preferably, the hand guide member comprises a hand guide path which defines the path of the golfer's hands through a substantial portion of a backswing.

Preferably, the hand guide path has a generally horizontal portion and an upwardly curving portion.

Preferably, the hand guide path is a slot, such that, in use, the hands pass therethrough.

Preferably, the hands remain in the space defined by the slot throughout a substantial portion of the backswing.

Preferably, the slot has a horizontal portion and an upwardly curving portion.

Preferably, the hand guide member comprises a lower substantially vertical planar portion and an upper substantially vertical planar portion, wherein, the lower substantially vertical planar portion and the upper substantially vertical planar portion lie in the same plane and are vertically spaced apart from one another.

Preferably, the vertical space between the lower substantially vertical planar portion and the upper substantially vertical planar portion is the slot of the hand guide member.

Preferably, the lower substantially vertical planar portion is generally L-shaped.

Preferably, the lower substantially vertical planar portion has a top curved edge which has a substantially horizontal section towards one end and an upwardly curving section towards the other end.

Preferably, the top curved edge of the lower substantially vertical planar portion defines the lower boundary of the slot.

Preferably, the upper substantially vertical planar portion is generally rectangular.

Preferably, the upper substantially vertical planar portion has a bottom edge which is substantially parallel to and spaced apart from the substantially horizontal section of the top curved edge of the lower substantially vertical planar portion.

Preferably, the bottom edge of the upper substantially vertical planar portion defines the upper boundary of the horizontal portion of the slot.

Preferably, the hand guide member further comprises an inclined planar portion.

Preferably, the inclined planar portion is connected to one side of the upper substantially vertical planar portion.

Preferably, the inclined planar portion has a generally horizontal edge and a generally vertical edge.

Preferably, the inclined portion has a curved edge.

Preferably, the curved edge is substantially opposed to and spaced apart from the upwardly curving section of the top curved edge of the lower substantially vertical planar portion.

Preferably, the curved edge of the inclined planar portion defines the upper boundary of the curved portion of the slot.

Preferably, the bottom edge of the upper substantially vertical planar portion and the curved edge of the inclined planar portion are aligned, so that they provide a substantially continuous upper boundary for the slot.

Preferably, the inclined planar portion, in use, is inclined towards the golfer.

Preferably, the hand guide member also comprises one or more support members for supporting the hand guide member relative to a surface.

Preferably, the one or more support members include feet and/or legs.

Preferably, the one or more support members are adjustable for adjusting the position of the hand guide member relative to golfers of differing heights.

Preferably, the one or more support members are connected to the bottom of the lower substantially vertical planar portion.

The hand guide member may be free standing.

The hand guide member need not be attached (ie. is separate) to the rest of the device.

Preferably, the device also comprises a foot positioner adapted, in use, to aid positioning of at least one of the golfer's feet throughout a substantial portion of a backswing.

Preferably, the foot positioner comprises a foot mat on which the front foot of the golfer in use is positioned. The "front foot" of the golfer is the left foot for a right-handed golfer or the right foot for a left-handed golfer.

Preferably, the foot positioner also comprises a ball alignment member for aligning the foot positioner relative to a golf ball position. The golf ball position is typically the position of an imaginary golf ball which the golfer visualises when practicing the golf swing. Alternatively, the golf ball position may be the position of some other real or imaginary target for real or imagined contact with a golf club head.

Preferably, the foot mat abuts the ball alignment member.

The foot mat may be fixed to the ball alignment member.

Preferably, the foot mat is substantially shaped as the sole of a shoe or foot, having a longitudinal axis.

Preferably, the foot mat is made of rubber or cloth.

Alternatively the foot mat can be made of any other suitable material.

Preferably, the foot mat abuts the ball alignment member at a side part of its heel.

Preferably, the foot mat has a portion cutaway at the side part of its heel to create a straight edge.

Preferably, the straight edge abuts the ball alignment member.

Preferably, the ball alignment member has a longitudinal axis.

Preferably, the foot mat abuts the ball alignment member such that the longitudinal axis of the foot mat is at approximately 22.degree. to the longitudinal axis of the ball alignment member.

Preferably, the foot mat rests on the ground.

Preferably, the foot mat is fixed to the ground by pegs, pins or any other suitable means.

Preferably, the ball alignment member extends away from the sheet.

The ball alignment member may be separate from the sheet. Alternatively, the ball alignment member may be connected to the sheet. The ball alignment member therefore also defines the starting point of the golf club. The head of the golf club at address is positioned proximate to the ball alignment member on the other side of the ball alignment member's longitudinal axis to the foot mat.

Preferably, the ball alignment member, in use, extends at least partly from between the feet of the golfer.

Preferably, the ball alignment member rests on the ground.

Preferably, the ball alignment member is fixed to the ground by pegs or other suitable means.

Preferably, the ball alignment member is a thin piece of timber, metal or plastic or any other suitable material.

Preferably, in use, the front foot of the golfer is positioned throughout a substantial portion of the backswing on the foot mat, abutting the ball alignment member.

Preferably, in use, the back foot (being the other foot to the front foot) is positioned on the other side of the ball alignment member.

Preferably, in use, the head of the golf club at address is positioned on the other side of the ball alignment member to the front foot.

Preferably, in use, the back foot has a longitudinal axis which is positioned substantially parallel to the ball alignment member.

Preferably, in use, the heels of the front and back feet are substantially aligned so that a line between them is substantially perpendicular to the ball alignment member.

Preferably, the front foot has a longitudinal axis, such that by positioning the front foot on the foot mat, the longitudinal axis of the front foot is at approximately 22.degree. to the longitudinal axis of the ball alignment member.

The foot positioner may be freestanding.

The foot positioner need not be attached to the rest of the device.

According to a second aspect of the present invention, there is provided a golf swing training device in the form of a hand guide member adapted, in use, to guide movement of a golfer's hands when the golfer executes a substantial portion of a backswing.

Preferably, the hand guide member comprises features as defined by one or more preferred features of the hand guide member described with reference to the first aspect of the present invention.

According to a third aspect of the present invention, there is provided a golf swing training device in the form of a foot positioner adapted, in use, to position a golfer's feet when the golfer executes a substantial portion of a backswing.

Preferably, the foot positioner comprises features as defined by one or more of the preferred features of the foot positioner described with reference to the first aspect of the present invention.

According to a fourth aspect of the present invention, there is provided a method of training a golfer to perform at least a substantial portion of a backswing, comprising the step of:

providing a surface which, in use, guides the shoulders of the golfer during at least a substantial portion of the backswing.

Preferably, the surface guides the shoulders so that the golfer's shoulders remain substantially in a plane during at least a substantial portion of the backswing.

Preferably, the surface is substantially planar.

According to a fifth aspect of the present invention, there is provided a golf swing training device for guiding the movement of a golfer's shoulders when the golfer executes a practice backswing, the device comprising a sheet of material having a substantially planar surface, and at least one support for supporting the sheet in an inclined orientation relative to the ground, so that the planar surface provides an inclined planar guide surface for guiding the golfer's shoulders so that they remain substantially in a single plane during a substantial portion of the backswing.

Preferably, the golf swing training device of the fifth aspect comprises one or more of the preferred features of the golf swing training device of first aspect of the present invention.

According to a sixth aspect of the present invention, there is provided a method of training a golfer to perform at least a substantial portion of a backswing comprising the step of providing a golf swing training device in accordance with at least one of the first, second, third or fifth aspects of the present invention.

Other preferred steps or features of the method will be evident from the above statements of preferred features.

BRIEF DESCRIPTION OF THE DRAWINGS

Preferred embodiments of the invention will now be described by way of example only, with reference to the accompanying drawings in which.

PREFERRED EMBODIMENTS OF THE INVENTION

Figure 1:
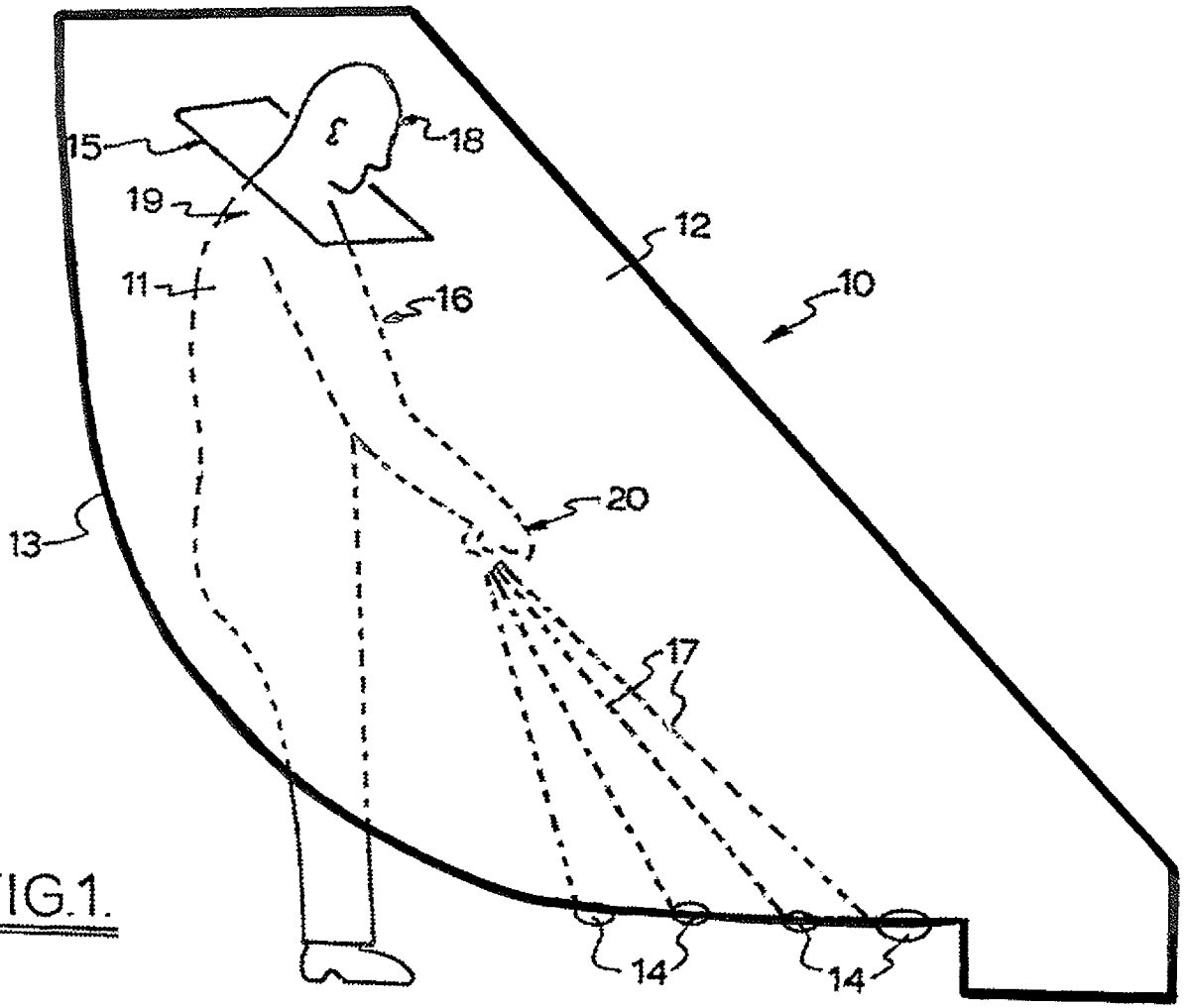
FIG. 1 is a schematic view of one preferred embodiment of a golf swing training device, in use, with the user shown holding a plurality of varied length golf clubs of various lengths.
Figure 2:
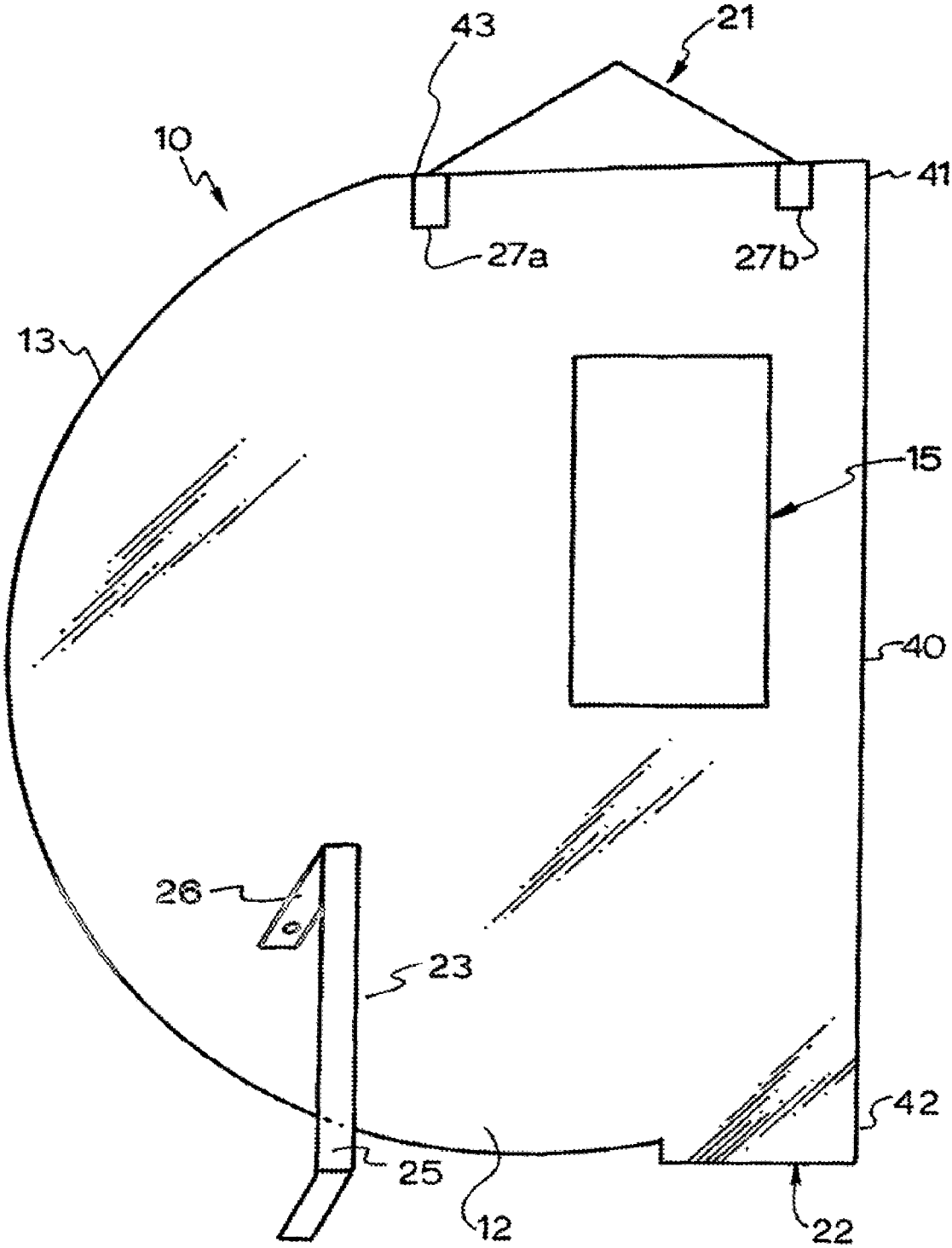
FIG. 2 is a top plan view of the golf training device of FIG. 1 and includes a spacing member, shown in perspective view, at the bottom left of the device.

Referring to FIGS. 1 and 2, a golf swing training device indicated generally by the number 10 is adapted to train a golfer 11 in using a correct backswing in a golf shot. The device 10 includes a thin sheet 12 which is constructed of a rigid material such as sheet timber, Perspex, fibreglass or any other material which may be suitable. The sheet 12 is substantially D-shaped, having a first straight edge 40 and an opposing arcuate edge 13. The first straight edge 40 is connected at its first end 41 by a second straight edge 43 to a first end of the arcuate edge 13. The first straight edge 40 is also connected at its second end 42 to a second end of the arcuate edge 13 by a foot 22. In use, the sheet is inclined so that the respective first ends of the first straight edge 40 and arcuate edge 13 are higher than the respective second ends. The foot 22 is shorter in length than the length of the second straight edge 43. The arcuate edge 13 is approximately a semi-circle.

The device 10 also includes an aperture 15 in the sheet 12 through which the head 18 of the golfer 11 may pass. The aperture 15 is located in the sheet 12 towards the first end 41 of the first straight edge 40, and proximate to the edge of the sheet 12 defined by the first straight edge 40. The aperture 15 indicates the correct position for the golfer to stand relative to the device so that he or she may practice the correct backswing.

FIG. 2 in particular shows various supports for the device 10. Attachment member 21, for example in the form of a wire, cable or chord, connected to the device 10 at reinforced attachment points 27*a* and 27*b*, is adapted to allow the device 10 to be hung on the side of a wall, clothesline, tree or similar support. At the other end of the device 10 is a foot 22 which is adapted to rest on the ground. The foot 22 may be secured to the ground by a number of anchor pegs (not shown) or similar such means. Likewise, the foot 22 may be secured by the addition of a suitable weight to prevent it from moving significantly. The device 10 is also provided with a spacing member 23 which acts to space apart the arcuate edge 13 from the ground. The spacing member 23 is attached to the upper surface of the sheet 12 via a first portion 26. The first portion 26 extends away from the sheet 12, approximately perpendicular to the sheet 12. A generally L-shaped second portion 25 of the spacing member 23 is connected to the first portion 26. In use, the second portion 25 passes over and is spaced apart from the arcuate edge 13 and rests upon, and may be secured to, the ground. The second portion may be secured to the ground using anchor pegs as described for the foot 22 above. The first portion 26 of the spacing member 23 is adapted to support the sheet 12 while enabling the spacing member 23 to maintain a clearance from the arcuate edge 13. This enables the club-head to pass the spacing member 23 during the backswing.

The device 10 is set-up for use by engaging the foot 22 and the support piece 23 with the ground and by coupling the attachment member 21 with the side of a wall, clothesline, tree or similar support. In use, the club (and thus the club-head), at the top of the backswing, pass under the attachment member 21. With reference to the correct address of the individual golfer 11, with the golfer's head 18 extending through the aperture 15, the height at which the attachment member 21 is coupled to the support and/or the length of the attachment member 21 is adjusted so that the sheet 12 is angled correctly, that is, so that the underside of the sheet 12 is substantially in the plane defined by the golfer's shoulders 19 and the head 14 of the club 17. Whilst this process might require assistance from another person, once the device 10 has been set-up, it can be left ready for use on a semi-permanent basis.

When using the device 10, the golfer 11 stands under the sheet 12 with his (or her, but referred to as his, for convenience) shoulders lightly brushing the underside of the sheet 12 and with his head 18 extending through the aperture 15 in the sheet 12. At address, the arms 16 hang from the shoulders 19 with the golf club 17 extending away from the golfer 11 such that the club-head 14 rests on the ground under the arcuate edge 13 of the sheet 12.

When executing the correct backswing, the shoulders 19 of the golfer 11 remain in light contact with the sheet, and therefore in a plane both at address and throughout a substantial portion of the backswing. The underside of the sheet 12 is positioned substantially on the plane of the shoulders 19 of the golfer 11. Thus, when a golfer 11 executes a backswing, the sheet 12 acts as a guide for the correct movement of the shoulders 19.

The club-head 14 of various golf clubs 17 also remains in the plane defined by the sheet 12 at address and throughout a substantial portion of the backswing. The arcuate edge 13 of the sheet 12, guides the club-head 14 throughout the backswing, thereby maintaining it in the correct plane, coplanar with the shoulders 19 throughout a substantial portion of the backswing. The hands 20 and arms 16 of the golfer do not lie on the plane throughout a substantial portion of the backswing. The golfer 11 practices his backswing by rotating the shoulders 19 (clockwise for right-handers and anti-clockwise for left-handers) in the plane as defined by the sheet 12. Throughout the backswing, the shoulders 19 never leave this plane, and the club-head 14 follows the path defined by the arcuate edge 13 of the sheet 12. As the golfer 11 rotates his shoulders 19, the club 17 and the hands 20 are taken back relatively low early in the backswing. Through the middle and final sections of the backswing, the golfer is forced to cock his wrists and fold his arms correctly so that his shoulders 19 and the club-head 14 remain on the plane defined by the sheet 12. The golfer's head remains substantially still throughout the backswing. Using the device 10, the golfer 11 can therefore practice the correct backswing by repeating these movements over and over again.

Figure 3:
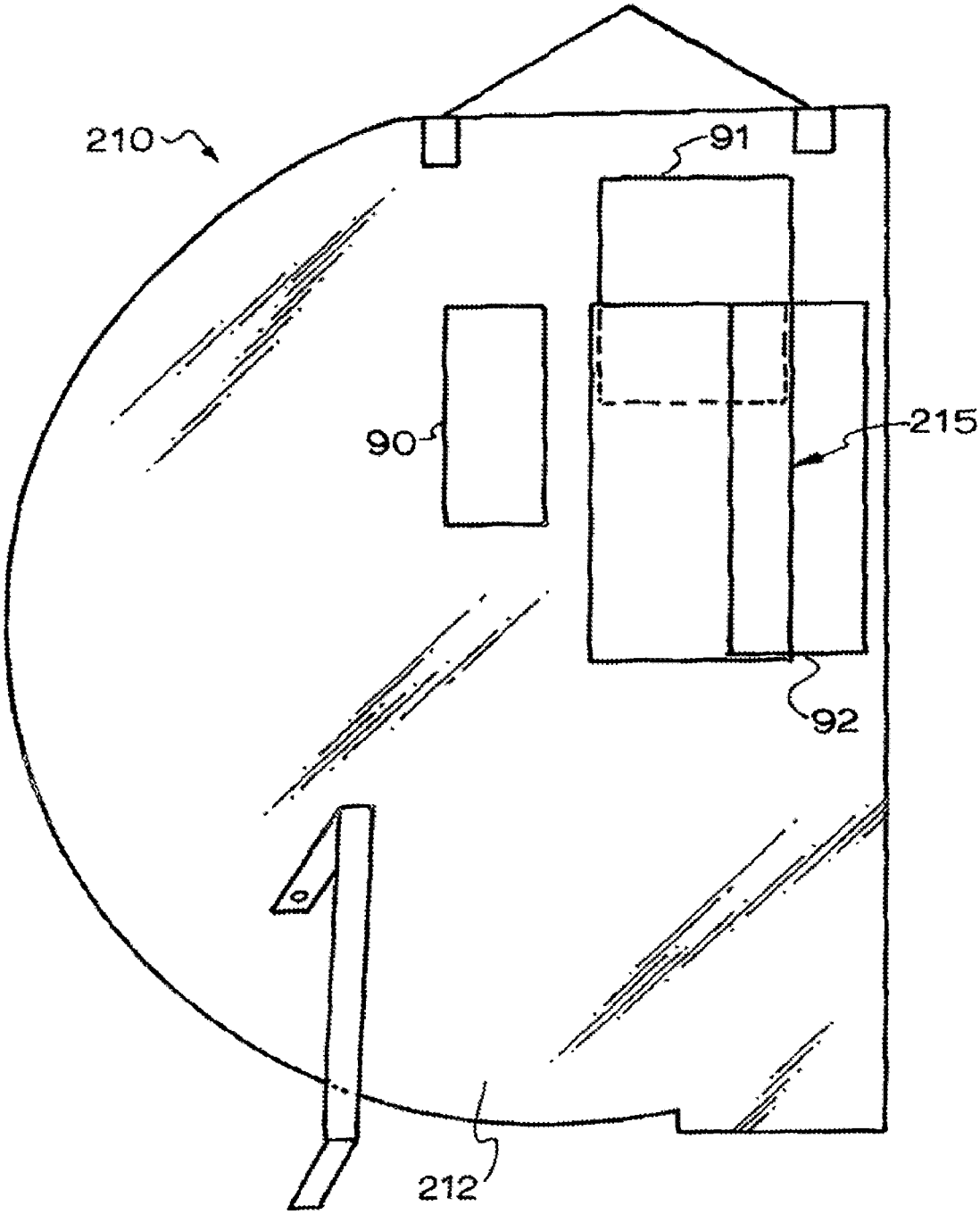
FIG. 3 is a top plan view of another embodiment of the golf training device.

FIG. 3 shows an embodiment of a golf training device 210 which includes additional features. Features of the device 210 which are similar to that described with reference to FIGS. 1 and 2 are designated by corresponding reference numerals but prefixed with the numeral 2.

The device 210 shown in FIG. 3 includes a window 90 in the sheet 212. The window 90 is positioned to allow the golfer to observe a substantial part of his or her backswing.

The device 210 also includes first and second slidable plates, denoted 91 and 92 respectively. The slidable plates 91, 92 are adapted to partially occlude the aperture 215 in the sheet 212. This is so that when golfers of differing dimensions (such as height or arm length) use the device 212, their correct position to stand relative to the device 210 can be adjusted quickly and easily. The first slidable plate 91 is adapted to slide in the direction of maximum gradient of the sheet 12 in use and to lightly engage the back of the neck of the golfer. The second slidable plate 92 is adapted to slide substantially horizontally in order to ensure that, in use, the aperture 215 is sufficiently narrow for both of a golfer's shoulders to brush against the device and be adequately guided. The plates 91, 92 may thus be moved in mutually perpendicular directions and be functionally regarded as forming part of the sheet. The first slidable plate 91 may slide either under or over the second slidable plate 92. As an alternative to sliding of the plates 91, 92, the plates may be moveable and securable relative to the aperture by other means, such as by use of hook and loop fasteners.

Figure 4:
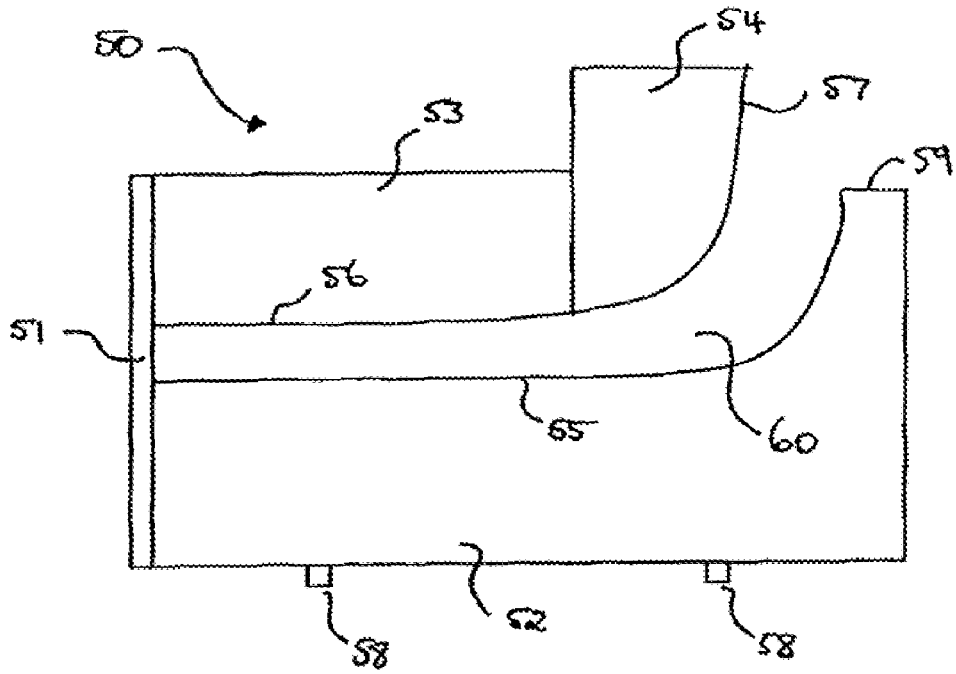
FIG. 4 is a front elevation view of a hand guide member of the golf swing training device, in isolation.
Figure 5:
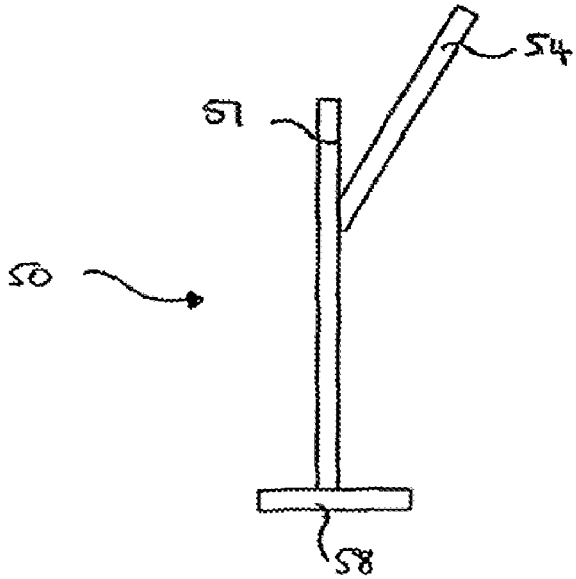
FIG. 5 is a side view of the hand guide member, in isolation.

Referring to FIGS. 4 and 5, the device 10 may also be provided with a hand guide member 50 for guiding the movement of the golfer's hands 20 throughout a substantial portion of a backswing. The hand guide member 50 has a substantially vertical post 51. The hand guide member 50 also has a lower substantially vertical planar portion 52 and an upper substantially vertical planar portion 53, which are attached to the post 51 such that they lie in the same plane and are vertically spaced apart from one another. An inclined planar portion 54 is connected to the upper substantially vertical planar portion 53 at the opposite end to which the upper substantially vertical planar portion 53 is attached to the post 51.

The lower substantially vertical planar portion 52 is generally L-shaped and has a top curved edge 55 connected at one end to the post 51 and at the other end to a short straight horizontal edge 59. The top curved edge 55 has a substantially horizontal section towards the end connected to the post 51, and an upwardly curving section towards the end connected to the short straight horizontal edge 59.

The upper substantially vertical planar portion 53 is generally rectangular, having a bottom edge 56 which is substantially parallel to and spaced apart from the substantially horizontal section of the top curved edge 55 of the lower substantially vertical planar portion 52. The inclined planar portion 54 is defined by a horizontal edge, a vertical edge and a curved edge 57. The curved edge 57 is substantially opposed to and spaced apart from the upwardly curving section of the top curved edge 55 of the lower substantially vertical planar portion 52. The inclined planar portion 54 is connected to the upper substantially vertical planar portion 53 such that edges 56 and 57 provide one continuous edge which defines the upper boundary of a slot 60. The lower boundary of the slot 60 is defined by the top curved edge 55.

In use, the golfer's hands 20 pass through the slot 60 and remain as such throughout a substantial portion of the backswing. In this way, the slot 60, and in particular, the edges 56, 57 which define the upper boundary of the slot guides the movement of the golfer's hands 20. The inclined planar portion 54 is angled towards the golfer 11 and thus the portion of the slot 60 defined by the curved edge 57 is also angled towards the golfer.

The hand guide member 50, as illustrated also has two legs 58, connected to the bottom of the lower substantially vertical planar portion 52, which engage the ground and maintain the hand guide member 50 in an upright position. The height of the legs 58 is adjustable in order for the hand guide member 50 to be correctly adjusted for golfers of differing heights. The hand guide member 50 is therefore able to be free standing and could be used separately to the rest of the device 10 in order to allow a golfer to practice correct positioning of the hands. However, it is considered that use of a hand guide is most beneficial when used in conjunction with a device which guides the shoulders.

Figure 6:
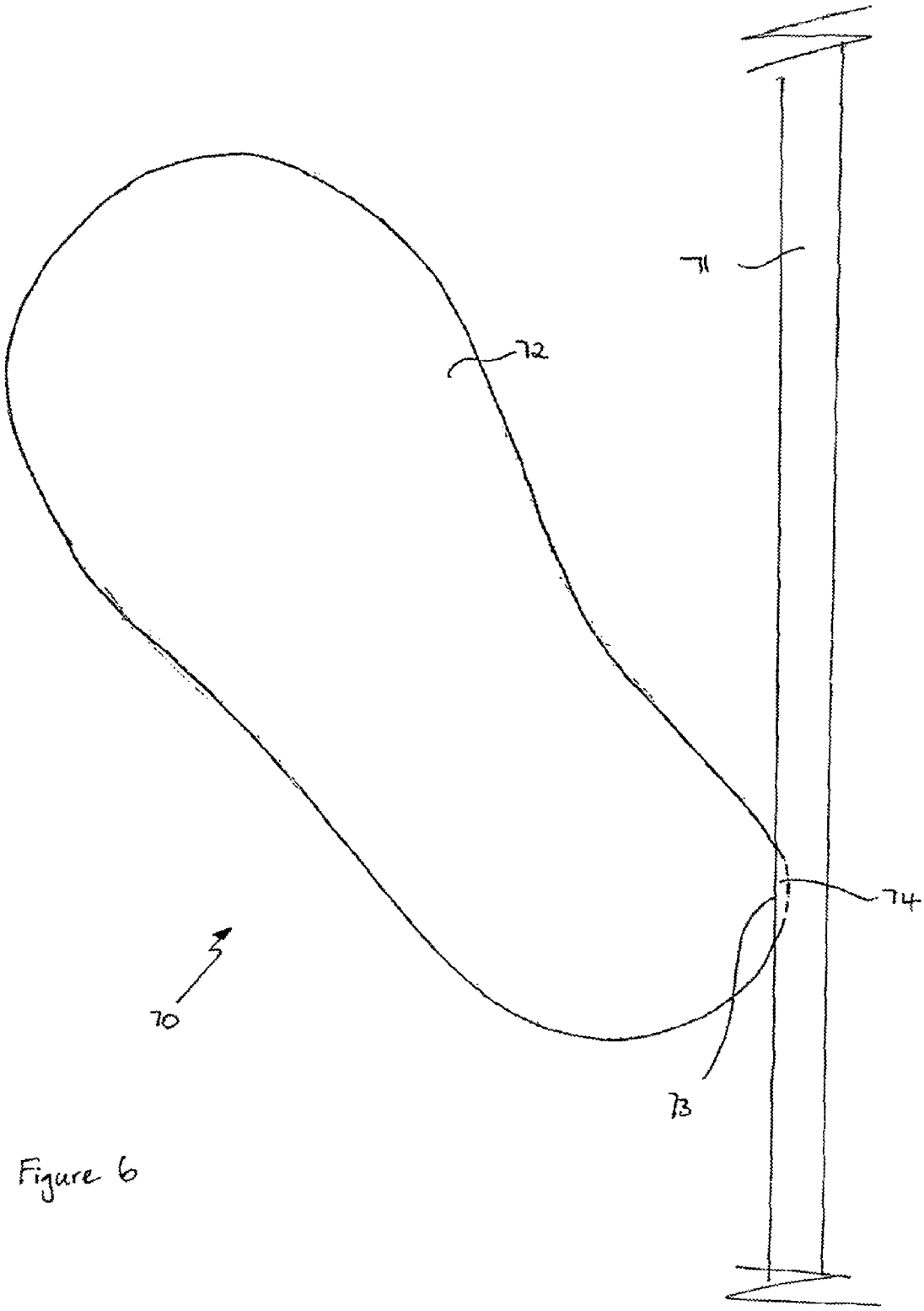
FIG. 6 is a top plan view of a foot positioner of the golf swing training device, in isolation.

Referring now to FIG. 6, the device 10 may also be provided with a foot positioner 70 for positioning the golfer's feet throughout a substantial portion of a backswing. The foot positioner 70 comprises a ball alignment member 71 and a foot mat 72.

The ball alignment member 71 is adapted, in use, to align the foot positioner 70 with a golf ball position (not shown) which will typically be the position of an imaginary golf ball which the golfer, when using the golf training device 10, imagines in order to practice his swing.

The ball alignment member 71 may be separated from or connected to the sheet 12. If the ball alignment member 71 is connected to the sheet 12, then the head 14 of the golf club 17, at address, will be proximate to one side of the ball alignment member 71. The ball alignment member 71 has a longitudinal axis, and extends away from or is connected to the sheet 12 to pass in use at least partly between the feet of the golfer. The ball alignment member 71 is a thin (approximately 12 mm (½ inch), thick) piece of timber, plastic, metal or other suitable material. The ball alignment member 71 rests on the ground and may be fixed thereto by a number of anchor pegs (not shown) or similar such means.

The foot mat 72 shows the golfer the correct position to place their left foot (for a right-handed golfer). The foot mat 72 is approximately the shape of a shoe sole or foot, having a longitudinal axis. The foot mat 72 abuts the ball alignment member 71 at the heel of the foot mat 72 and with its longitudinal axis at approximately 22.degree. to the longitudinal axis of the ball alignment member 71. The foot mat 72 may be permanently fixed to the ball alignment member 71.

To maintain the foot mat 72 in the correct position relative to the ball alignment member 71, a portion 74 of the foot mat 72 is cut away. This portion 74 is shown in dotted outline in FIG. 6. The cut-away portion 74 is located at the heel of the foot mat 72 abutting the ball alignment member 71. The removal of the cut-away portion 74 creates a straight abutting edge 73 which abuts against the straight edge of the ball alignment member 71 so that the foot mat 72 is correctly orientated relative to the ball alignment member 71. The foot mat 72 is made of rubber or cloth or other suitable material. The foot mat could be formed from a rigid material such as timber. The foot mat rests on the ground and can be fixed thereto by pegs, pins or any other suitable means.

In use, the foot positioner 70 is placed under the sheet 12 to indicate the correct position for the golfer to place his feet. The left foot (for a right-handed golfer) is placed on top of the foot mat 72, with the heel of the foot abutting the ball alignment member 71. In this position, a longitudinal axis of the left foot should be approximately 22.degree. to the longitudinal axis of the ball alignment member 71. The right foot of the golfer is placed on the other side of the ball alignment member 71 to the left foot and is substantially parallel to the ball alignment member 71. The heels of the left and right feet should be substantially aligned so that a line between them is substantially perpendicular to the ball alignment member 71. Clearly for a left-handed golfer the feet would be the other way around.

The foot positioner 70 is able to be free standing and could be used separately to the rest of the device 10 in order to allow a golfer to practice correct positioning of the feet. However, it is considered that use of a foot positioner is most beneficial when used in conjunction with a device which guides the shoulders.

The described preferred embodiments thus provide structurally simple, economically viable devices for helping a golfer correctly position his shoulders and/or hands and/or feet substantially throughout a practice backswing.

Of course, many variations and alternative embodiments to those illustrated will be apparent to those skilled in the art. For example, although a thin substantially rigid sheet is the preferred basis for devices of the type illustrated in FIGS. 1 to 3, an alternative structure, such as a framework, rather than a continuous sheet, could be provided. In one embodiment, a sheet is used but is formed as a number of substantially rigid panels provided with joints such as hinges therebetween to allow the device to be folded for convenient storage or transportation. Such an embodiment would preferably include locking means (such as substantially rigid bars or pins which fit into loops or sleeves) for locking the joints in use, so that the sheet can retain a substantially planar configuration.

In the claims which follow and in the preceding description of the invention, except where the context requires otherwise due to express language or necessary implication, the word "comprise" or variations such as "comprises" or "comprising" is used in an inclusive sense, ie. to specify the presence of the stated features but not to preclude the presence or addition of further features in various embodiments of the invention.

Modifications and improvements may be incorporated without departing from the scope of the present invention.

The invention claimed is:

1. A golf swing training device comprising a substantially planar surface, wherein the surface, in use, acts as a guide for the movement of a golfer's shoulders when the golfer executes a substantial portion of a backswing, the substantially planar surface having an aperture formed therein dimensioned to allow the golfer's head to pass therethrough, and wherein the aperture is sized so that when the golfer executes a substantial portion of a backswing both of the golfer's shoulders can brush against the device, adjacent the aperture, so that the movement of the golfer's shoulders is guided by the device throughout said substantial portion of said backswing.

2. A golf swing training device as claimed in claim 1, wherein the device guides the golfer's shoulders so that they remain substantially in a single plane during a substantial portion of the backswing, the plane being defined by the surface.

3. A golf swing training device as claimed in claim 1, wherein the device comprises a club guiding portion for guiding a golf club head through at least a portion of the backswing, and wherein the club guiding portion comprises a curved edge of the surface.

4. A golf swing training device as claimed in claim 3, wherein the device further comprises a spacing member for spacing apart the curved edge from the ground to enable the club head to pass between the curved edge and ground when the golfer executes a backswing.

5. A golf swing training device as claimed in claim 1, wherein the device further comprises an anchor for coupling a first end of the planar surface to the ground.

6. A golf swing training device as claimed in claim 1, wherein the golf swing training device further comprises a support for elevating a second end of the surface relative to a first end so that the surface extends as an inclined plane from at least shoulder height of a typical standing golfer substantially to the ground.

7. A golf swing training device as claimed in claim 1, wherein the surface is defined by a thin, substantially rigid sheet of material.

8. A golf swing training device for guiding the movement of a golfer's shoulders when the golfer executes a practice backswing, the device comprising a sheet of material having a substantially planar surface, and at least one support for supporting the sheet in an inclined orientation relative to the ground, so that the planar surface provides an inclined planar guide surface for guiding the golfer's shoulders so that they remain substantially in a single plane during a substantial portion of the backswing wherein the sheet has an aperture formed therein to allow the golfer's head to pass therethrough, and wherein the aperture is sized so that when the golfer executes a substantial portion of a backswing both of the golfer's shoulders can brush against the device, adjacent the aperture, so that the movement of the golfer's shoulders is guided by the device.

9. A golf swing training device having a front and a rear, comprising:

a substantially planar surface having an aperture formed therein dimensioned to allow a golfer's head to pass therethrough;

a rear support attached to a more rearward part of the substantially planar surface;

a front support attached to a more forward part of the substantially planar surface; and a club head guiding portion at least a part of which is provided at or adjacent the front of the device;

wherein the rear and front supports are configured to support the substantially planar surface in an inclined orientation with a rear of the substantially planar surface higher than a front of the substantially planar surface;

wherein the device provides first and second shoulder guide portions, adjacent respective first and second sides of the aperture, which in use act as guides for the movement of respective first and second shoulders of a golfer when the golfer executes a substantial portion of a backswing, the guide portions being arranged to allow the first and second shoulders to brush against the respective shoulder guide portions during at least a substantial portion of a backswing so that said first and second shoulders are thereby guided by the device;

wherein the club head guiding portion comprises a curved guide for guiding a golf club head through at least a substantial portion of a golf backswing and wherein the front support is adapted to support at least part of the club head guiding portion and to space said part of the club head guiding portion away from the ground so that a golf club head can pass between the club head guiding portion and the ground when said golf club head is being guided through at least a portion of the backswing by the club head guiding portion.

10. A golf swing training device as claimed in claim 9, wherein the first and second shoulder guide portions are arranged to guide the golfer's shoulders so that they move substantially in a single plane during a substantial portion of the backswing, the plane being defined by the surface and wherein the club guiding portion defines a path for the golf club head which is substantially within said single plane.

11. A golf swing training device as claimed in claim 10, wherein the club guiding portion comprises a curved edge of the surface.

12. A golf swing training device as claimed in claim 9, wherein the device further comprises one or more adjusters for adjusting the aperture so that golfers of various dimensions may be correctly accommodated relative to the device.

13. A golf swing training device as claimed in claim 12, wherein at least one adjuster comprises a positionable closure member which is adapted to partially occlude the aperture.

14. A golf swing training device as claimed in claim 9, wherein the device further comprises an anchor portion for coupling a first end of the planar surface to the ground.

15. A golf swing training device as claimed in claim 9, wherein the substantially planar surface extends from shoulder height substantially to the ground.

16. A golf swing training device as claimed in claim 9, wherein the surface is defined by a sheet of material.

17. A golf swing training device as claimed in claim 16, wherein the sheet is a thin, substantially rigid sheet.

* * * * *